US011203477B2

(12) United States Patent
Hartley

(10) Patent No.: US 11,203,477 B2
(45) Date of Patent: Dec. 21, 2021

(54) INTEGRATED PACKAGE OPENING FEATURE

(71) Applicant: Sonoco Development, Inc., Hartsville, SC (US)

(72) Inventor: Scott Huntington Hartley, Columbia, SC (US)

(73) Assignee: SONOCO DEVELOPMENT, INC., Hartsville, SC (US)

( * ) Notice: Subject to any disclaimer, the term of this patent is extended or adjusted under 35 U.S.C. 154(b) by 228 days.

(21) Appl. No.: 14/928,489

(22) Filed: Oct. 30, 2015

(65) Prior Publication Data

US 2017/0121086 A1 May 4, 2017

(51) Int. Cl.

*B65D 75/58* (2006.01)
*B65D 75/66* (2006.01)
*B65D 30/08* (2006.01)

(52) U.S. Cl.

CPC ..... *B65D 75/66* (2013.01); *B65D 31/02* (2013.01); *B65D 75/5827* (2013.01); *B65D 75/5844* (2013.01)

(58) Field of Classification Search

CPC ..... B65D 75/58; B65D 75/5805; B65D 75/5811; B65D 75/5827; B65D 75/5833; B65D 75/5838; B65D 75/5844; B65D 75/5894; B65D 31/02

USPC ..... 383/200, 203–205, 207–209; 206/812, 206/494, 233, 772, 773; 221/63

See application file for complete search history.

(56) References Cited

U.S. PATENT DOCUMENTS

| | | | |
|---|---|---|---|
| 1,827,636 | A | 10/1931 | Ames |
| 2,131,575 | A | 9/1938 | Whipple |
| 2,861,735 | A | 11/1958 | Faltin |
| 2,952,395 | A | 9/1960 | Spees |

(Continued)

FOREIGN PATENT DOCUMENTS

| | | |
|---|---|---|
| CN | 1558827 | 12/2004 |
| DE | 8903067 | 7/1989 |

(Continued)

OTHER PUBLICATIONS

Office Action for corresponding Canadian Patent Application No. 2,847,432 dated Jan. 24, 2018.

(Continued)

*Primary Examiner* — Jes F Pascua
*Assistant Examiner* — Nina K Attel
(74) *Attorney, Agent, or Firm* — Nelson Mullins Riley & Scarborough LLP

(57) ABSTRACT

A package is described that includes a laminate structure with a first layer and a second layer. The first layer is adjacent a compartment of the package and includes a predefined cut through which access is provided to the contents of the package. The second layer includes an integrated pull strip that is at least partially defined by a line of weakness formed in the second layer. The pull strip overlies the predefined cut and is configured to be separated from a remainder of the second layer by a user. In this way, separation of the pull strip from the package (e.g., as the pull strip is peeled away from the package) may serve to expose the predefined cut and allows the first and second edges to be moved apart to provide access to the compartment and the contents stored therein via the predefined cut.

15 Claims, 4 Drawing Sheets

(56) References Cited

U.S. PATENT DOCUMENTS 2,991,001 A 7/1961 Hughes
3,127,087 A 3/1964 Spees
3,239,097 A * 3/1966 Bates ..... B65D 83/0805 206/494
3,259,303 A 7/1966 Repko
3,266,965 A 8/1966 Spees
3,279,331 A 10/1966 Platt
3,335,939 A 8/1967 Robinson, Jr.
3,942,640 A 3/1976 Hellstrom
3,946,872 A 3/1976 Sturm
4,023,292 A 5/1977 Shibata et al.
4,066,600 A 1/1978 Pletcher et al.
4,185,754 A * 1/1980 Julius ..... A47K 10/421 206/210
4,264,662 A 4/1981 Taylor et al.
4,280,653 A 7/1981 Elias
4,325,393 A 4/1982 Thomas
4,345,393 A 8/1982 Price et al.
4,353,460 A 10/1982 Kahn
4,372,460 A 2/1983 Brochman et al.
4,381,848 A 5/1983 Kahn
4,452,842 A 6/1984 Borges et al.
4,464,158 A 8/1984 Kardon
4,502,599 A 3/1985 Perecman
4,531,668 A 7/1985 Forbes, Jr.
4,574,952 A * 3/1986 Masui ..... B65D 83/0835 206/460
4,584,201 A 4/1986 Boston
4,679,693 A 7/1987 Forman
4,738,365 A 4/1988 Prater
4,785,940 A 11/1988 Wilson
4,838,429 A 6/1989 Fabisiewicz et al.
4,846,504 A 7/1989 MacGregor et al.
4,871,265 A 10/1989 Peck
4,913,560 A 4/1990 Herrington
5,044,776 A 9/1991 Schramer et al.
5,123,535 A 6/1992 Patnode et al.
5,235,149 A 8/1993 Boehrer
5,265,794 A 11/1993 Johnston
5,415,910 A 5/1995 Knauf
5,484,167 A 1/1996 Donaldson et al.
5,507,428 A 4/1996 Robinson, Jr. et al.
5,569,515 A 10/1996 Rice, II et al.
5,571,358 A 11/1996 Napier et al.
5,832,145 A 11/1998 Dais et al.
5,833,368 A 11/1998 Kaufman
5,855,435 A 1/1999 Chiesa
5,871,096 A 2/1999 Yakich
5,902,045 A 5/1999 Resteghini
5,910,348 A 6/1999 Hart-Smith et al.
5,947,368 A 9/1999 Thresher et al.
5,958,486 A 9/1999 Ringdahl et al.
5,979,748 A 11/1999 Drummond et al.
6,026,853 A 2/2000 Osterbrink
6,041,929 A 3/2000 Brunner et al.
6,047,488 A 4/2000 Tuskiewicz
6,056,141 A 5/2000 Navarini et al.
6,190,485 B1 2/2001 Cahill et al.
6,196,450 B1 3/2001 Varadarajan et al.
6,206,570 B1 3/2001 Cortopassi
6,234,386 B1 5/2001 Drummond et al.
6,264,098 B1 7/2001 Drummond et al.
6,270,004 B1 8/2001 Drummond et al.
6,302,321 B1 10/2001 Reese et al.
6,328,203 B1 12/2001 Tedford, Jr.
6,334,711 B1 1/2002 Risgalla et al.
6,383,592 B1 5/2002 Lowry et al.
6,428,867 B1 8/2002 Scott et al.
6,460,720 B1 10/2002 Massey et al.
6,497,336 B2 12/2002 Grayer
6,544,613 B1 4/2003 Varadarajan
6,589,622 B1 7/2003 Scott
6,620,275 B1 9/2003 Avila et al.
6,660,353 B2 12/2003 Siedl
6,746,743 B2 1/2004 Knoerzer et al.
6,857,561 B2 2/2005 Williams et al.
6,858,108 B2 2/2005 Matthews et al.
6,890,112 B2 5/2005 Kline
6,991,375 B2 * 1/2006 Clune ..... A44B 18/0084 383/203
7,144,635 B2 12/2006 Hawes et al.
7,189,300 B2 3/2007 Knoerzer et al.
7,228,961 B2 6/2007 Koetter et al.
7,344,744 B2 3/2008 Sierra-Gomez et al.
7,416,768 B2 8/2008 Knoerzer et al.
7,422,782 B2 9/2008 Haedt et al.
7,608,317 B2 10/2009 Keckeisen et al.
7,686,513 B2 3/2010 Knoerzer et al.
7,717,620 B2 5/2010 Hebert et al.
7,789,236 B2 9/2010 Burgess
7,828,923 B2 11/2010 Patel
7,955,678 B2 6/2011 Stogbauer et al.
8,051,979 B2 11/2011 Smith et al.
8,408,451 B2 4/2013 Adam et al.
8,443,578 B2 5/2013 Sargin et al.
8,544,718 B2 10/2013 Yamato et al.
8,646,975 B2 2/2014 Moehlenbrock et al.
8,740,052 B2 6/2014 Drummond
8,746,490 B2 6/2014 Huffer et al.
9,096,346 B2 8/2015 Huffer
9,278,506 B2 3/2016 McLean
9,783,354 B2 10/2017 Rhue
9,802,746 B2 10/2017 Rhue
9,850,056 B2 12/2017 Shaw et al.
9,928,757 B2 3/2018 Huffer et al.
10,026,339 B2 7/2018 Huffer et al.
10,138,026 B2 11/2018 Branyon
10,150,600 B2 12/2018 Huffer
2003/0178429 A1 9/2003 Williams et al.
2004/0013827 A1 1/2004 Zuser et al.
2004/0064983 A1 4/2004 Joseph
2004/0079763 A1 4/2004 Powell et al.
2005/0031814 A1 2/2005 Dawes
2005/0078890 A1 * 4/2005 Abe ..... B65D 33/2533 383/201
2005/0109652 A1 * 5/2005 Goepfert ..... B65D 75/58 206/494
2005/0153113 A1 7/2005 Hseih et al.
2005/0276525 A1 12/2005 Hebert et al.
2006/0138207 A1 6/2006 Levine et al.
2006/0147129 A1 * 7/2006 Miller ..... B65D 75/5838 383/205
2006/0198986 A1 9/2006 Keckeisen et al.
2007/0051790 A1 3/2007 Smith et al.
2008/0037911 A1 2/2008 Cole et al.
2008/0044114 A1 2/2008 Hall et al.
2008/0073308 A1 3/2008 Yousif
2008/0190937 A1 8/2008 Cho
2008/0240627 A1 10/2008 Cole et al.
2008/0272016 A1 * 11/2008 Anderson ..... B65D 75/5833 206/233
2009/0194451 A1 8/2009 Leiner et al.
2009/0226117 A1 9/2009 Davis et al.
2009/0274799 A1 11/2009 Lee et al.
2010/0019022 A1 1/2010 Ryan et al.
2010/0098355 A1 4/2010 Jansen
2010/0111453 A1 5/2010 Dierl
2010/0147724 A1 6/2010 Mitra-Shah et al.
2010/0288760 A1 11/2010 McGrew et al.
2010/0323134 A1 12/2010 Bostian et al.
2011/0038569 A1 * 2/2011 Huffer ..... B65D 33/20 383/207
2011/0049168 A1 3/2011 Loftin
2011/0089177 A1 4/2011 Thorstensen-Wolf
2011/0204056 A1 * 8/2011 Veternik ..... B65D 75/5844 220/270
2012/0082764 A1 4/2012 Paterson
2012/0125932 A1 5/2012 Sierra-Gomez et al.
2012/0177307 A1 7/2012 Duan et al.
2012/0314979 A1 12/2012 Heininga
2013/0011527 A1 1/2013 Renders et al.
2013/0026170 A1 1/2013 Zerfas et al.
2013/0056470 A1 3/2013 Hallak
2013/0089280 A1 4/2013 Tseng et al.

(56) References Cited

U.S. PATENT DOCUMENTS

| | | | |
|---|---|---|---|
| 2013/0101239 | A1 | 4/2013 | Kropf et al. |
| 2013/0114918 | A1 | 5/2013 | Lyzenga et al. |
| 2013/0121624 | A1 | 5/2013 | Lyzenga et al. |
| 2013/0279832 | A1 | 10/2013 | Burri et al. |
| 2013/0320019 | A1 | 12/2013 | Tinoco et al. |
| 2014/0000219 | A1 | 1/2014 | Pezzoli |
| 2014/0079343 | A1 | 3/2014 | Lyzenga et al. |
| 2014/0270597 | A1 | 9/2014 | Friedman et al. |
| 2014/0363545 | A1* | 12/2014 | Veternik ..... B65D 75/5844 426/108 |
| 2014/0376836 | A1 | 12/2014 | Schieber |
| 2015/0158643 | A1 | 6/2015 | Coker et al. |
| 2015/0297005 | A1 | 10/2015 | Janor |
| 2015/0353238 | A1 | 12/2015 | Moehlenbrock et al. |
| 2016/0009447 | A1 | 1/2016 | Rhue |
| 2016/0096667 | A1 | 4/2016 | Huffer |
| 2016/0122109 | A1 | 5/2016 | Clark et al. |
| 2016/0130041 | A1 | 5/2016 | Giorgio et al. |
| 2016/0167680 | A1 | 6/2016 | Early |
| 2016/0227835 | A1 | 8/2016 | Swede |
| 2016/0236844 | A1 | 8/2016 | Gagne et al. |
| 2016/0288960 | A1 | 10/2016 | Branyon |
| 2016/0343275 | A1 | 11/2016 | Huffer et al. |
| 2017/0121086 | A1 | 5/2017 | Hartley |
| 2017/0121088 | A1 | 5/2017 | Rhue |
| 2017/0283149 | A1 | 10/2017 | Rhue |
| 2017/0345344 | A1 | 11/2017 | Huffer et al. |

FOREIGN PATENT DOCUMENTS

| | | | |
|---|---|---|---|
| EP | 0488967 | A1 | 6/1992 |
| EP | 0499647 | B1 | 1/1995 |
| EP | 0952087 | A2 | 10/1999 |
| EP | 1080874 | | 3/2001 |
| EP | 1477408 | A1 | 11/2004 |
| EP | 1537990 | A2 | 6/2005 |
| EP | 1770025 | A2 | 4/2009 |
| FR | 1514374 | A | 2/1968 |
| FR | 2463468 | A1 | 2/1981 |
| GB | 2147564 | A | 5/1985 |
| GB | 2491646 | A | 12/2012 |
| JP | 2000-203654 | A | 7/2000 |
| JP | 2013-147269 | A | 8/2013 |
| WO | WO 95/29097 | A1 | 11/1995 |
| WO | WO 96/25333 | A1 | 8/1996 |
| WO | WO 98/28728 | A1 | 7/1998 |
| WO | 03/062090 | A1 | 7/2003 |
| WO | 2006/093898 | A1 | 9/2006 |
| WO | 2006132761 | A2 | 12/2006 |
| WO | WO 2008/086389 | A2 | 7/2008 |
| WO | 2011158014 | A1 | 12/2011 |
| WO | WO 2012/036765 | A1 | 3/2012 |
| WO | WO 2014/186571 | A2 | 11/2014 |
| WO | 2015/009658 | A2 | 1/2015 |

OTHER PUBLICATIONS

"Tamper-evidence: Consumers have come to expect tamper-evidence for drugs, foods"; Packaging (Boston, Mass); Mar. 19, 1989; vol. 34, No. 5 (3 pgs.).
"Innovations for opening and closing"; Food Trade Review; Oct. 1993; vol. 63, No. 4 (3 pgs.).
Kate Bertrand; "Improve security through packaging: emerging technologies can help create a package that safeguards products from tampering and protects your brand from counterfeiting"; Food Processing; Feb. 2006; vol. 67, No. 2 (5 pgs.).
U.S. Appl. No. 15/442,779, entitled "Resealable Flexible Packaging", filed Feb. 27, 2017.
U.S. Appl. No. 15/656,481, entitled "Tamper Evident Hybrid Resealable Container", filed Jul. 21, 2017.
U.S. Appl. No. 15/807,200, entitled "Membrane Lid With Integrated Peelable Portion", filed Nov. 8, 2017.
U.S. Appl. No. 15/676,167, entitled "Flexible Laminate for Packaging with Integrated Peelable Portion", filed Aug. 14, 2017.
LPS Industries, Loc n Press Pressure Sensitive Zippered Envelopes, www.lpsind.com, accessed Apr. 1, 2015.
ITC, Custom Adhesive Tape Manufacturing & Design, www.itctapes.com, accessed Feb. 2, 2015.
Clearbags, Value Crystal Clear Bags, www.clearbags.com, accessed Apr. 1, 2015.
International Search Report and Written Opinion for corresponding Paris Treaty Convention Application PCT/US2017/064594 dated Mar. 27, 2018, all pages enclosed.
Non-final Office Action for U.S. Appl. No. 14/676,390 dated Apr. 27, 2018.
May 2, 2018 Office Action issued in U.S. Appl. No. 14/871,398.
Jul. 26, 2018 Extended European Search Report issued in European Patent Application No. 18174601.7.
Jul. 28, 2016 Extended European Search Report issued in European Patent Application No. 16165679.8.
Jan. 11, 2017 Office Action issued in Canadian Patent Application No. 2,927,049.
Nov. 19, 2015 Search Report and Written Opinion issued in International Patent Application No. PCT/IB2015/057508.
Jul. 19, 2016 Office Action issued in European Patent Application No. 15 175 851.3.
Nov. 11, 2015 Search Report issued in European Patent Application No. 15 175 851.3.
Jun. 14, 2016 Office Action issued in U.S. Appl. No. 14/328,305.
Sep. 8, 2016 Office Action issued in U.S. Appl. No. 14/328,305.
Nov. 8, 2016 Office Action issued in Chinese Patent Application No. 201510402006.6.
Mar. 29, 2017 Office Action issued in Chinese Patent Application No. 201510402006.6.
Nov. 25, 2016 Notice of Allowance issued in U.S. Appl. No. 14/328,305.
Apr. 19, 2017 Office Action issued in U.S. Appl. No. 15/408,620.
Jun. 6, 2017 Notice of Allowance issued in U.S. Appl. No. 15/408,620.
Nov. 25, 2014 Office Action issued in Canadian Patent Application No. 2,847,432.
Sep. 17, 2018 Extended European Search Report issued in European Patent Application No. 18174641.3.
Oct. 8, 2019 Office Action issued in U.S. Appl. No. 15/442,779.
Oct. 9, 2019 Examination Report issued in European Patent Application No. 18174601.7.
Nov. 18, 2019 Office Action issued in U.S. Appl. No. 15/807,200.
Apr. 2, 2019 Office Action issue in Canadian Patent Application No. 3,006,160.
Dec. 6, 2018 Search Report and Written Opinion of the International Searching Authority issued in International Patent Application No. PCT/US2018/054170.
Jul. 11, 2016 Search Report issued in European Patent Application No. 16163438.1.
May 1, 2020 Notice of Allowance issued in U.S. Appl. No. 16/008,513.
Oct. 1, 2018 Notice of Allowance issued in U.S. Appl. No. 14/871,398.
Apr. 30, 2020 Office Action issued in U.S. Appl. No. 15/442,779.
Mar. 10, 2020 Office Action issued in U.S. Appl. No. 15/807,200.
May 31, 2019 Office Action issued in U.S. Appl. No. 15/807,200.
Mar. 27, 2018 Search Report and Written Opinion issued in International Patent Application No. PCT/US2017/064594.
Dec. 31, 2019 Office Action issued in Canadian Patent Application No. 3006160.
Final Office Action in U.S. Appl. No. 15/087,200, dated Mar. 1, 2021, 12 pages.
Exam Report issued in EP Application No. 18174601.7, dated Mar. 10, 2021, 3 pages.

* cited by examiner

INTEGRATED PACKAGE OPENING FEATURE

BACKGROUND

The present disclosure relates in general to packaging for products, and more particularly to bags, pouches, and containers incorporating a flexible laminate. The disclosure is especially concerned with integrated structures and techniques for opening a package to facilitate a user's access to the contents held therein.

Flexible materials, such as polymers and flexible films, are often used to construct packages for products, such as bags and pouches. Such packages can be used to hold a variety of items, such as food items including trail mix, chips, nuts, fruit pieces, cookies, crackers, and other foods. Often, the package may be difficult to grasp or open and may, in some cases, require the consumer to user scissors or a knife to gain access to the package contents, either by design or as a result of consumer frustration.

BRIEF SUMMARY

Embodiments of the invention described herein provide improved packages and methods for constructing packages that provide a mechanism for facilitating the opening of a package by providing an integrated pull strip in one layer of the packaging laminate that overlies a predefined cut, such as a slit, that is preformed in another layer of the packaging laminate. Thus, by tearing away the integrated pull strip, the user exposes the underlying predefined cut and is able to access the contents of the package via the predefined cut.

Accordingly, embodiments of the invention provide a package defining a compartment for storing contents, the package comprising a laminate structure including a first layer and a second layer. The first layer defines a first surface, adjacent the compartment, and a second surface opposite the first surface, where the first layer includes a predefined cut through the first and second surfaces. The second layer is laminated to the second surface of the first layer. The second layer comprises an integrated pull strip that is at least partially defined by a line of weakness formed in the second layer, and the pull strip overlies the predefined cut and is configured to be separated from a remainder of the second layer by a user. The predefined cut defines a first edge and a second edge adjacent the first edge, and separation of the pull strip from the package serves to expose the predefined cut and allows the first and second edges to be moved apart to provide access to the compartment and the contents stored therein via the predefined cut. In some cases, the predefined cut extends at least a portion of a width of the package.

The line of weakness may, in some embodiments, comprise a continuous cut line defined through a portion of a thickness of the second layer. In other embodiments, the line of weakness comprises a series of perforations.

In some cases, the package may comprise a first panel peripherally sealed to a second panel to define the compartment therebetween, where at least one of the first or second panels comprises the laminate structure. Each of the first and second panels may define first and second side edges, and the first panel may be peripherally sealed to the second panel via first and second longitudinal seals formed along adjoining first and second side edges. The pull strip may comprise an end defined in one of the first or second longitudinal seals. The end may be configured to be gripped by the user, and the end may be defined via a continuous cut line formed through the thickness of the second layer.

In some embodiments, the second layer may be laminated to the second surface of the first layer via an adhesive. The adhesive may be pattern applied, and the pull strip may be defined in an adhesive-free region of the laminate. The pull strip may comprise an end configured to be gripped by the user, and the end may be defined via a continuous cut line formed through the thickness of the second layer.

In other embodiments, a laminate structure is provided for forming a package. The laminate structure comprises a first layer defining a first surface and a second surface opposite the first surface. The first layer includes a predefined cut through the first and second surfaces and a second layer laminated to the second surface of the first layer. The second layer comprises an integrated pull strip that is at least partially defined by a line of weakness formed in the second layer, where the pull strip overlies the predefined cut and is configured to be separated from a remainder of the second layer by a user. The predefined cut defines a first edge and a second edge adjacent the first edge, and separation of the pull strip from the remainder of the second layer serves to expose the predefined cut of the first layer and allows the first and second edges to be moved apart.

In some cases, the second layer may be laminated to the second surface of the first layer via an adhesive, where the adhesive is pattern applied, and where the pull strip is defined in an adhesive-free region of the laminate. The pull strip may comprise an end configured to be gripped by the user, and the end may be defined via a continuous cut line formed through the thickness of the second layer. The line of weakness, in some cases, may comprise a continuous cut line defined through a portion of a thickness of the second layer. In some embodiments, the predefined cut line may comprise a slit.

In still other embodiments, a method of manufacturing a package is provided that includes an integrated pull strip for providing access to contents stored within a compartment of the package. The method comprises laminating a first layer to a second layer to form a laminate structure, wherein the first layer defines a first surface, adjacent a compartment of the package, and a second surface opposite the first surface. The method further includes forming a predefined cut in the first layer through the first and second surfaces, where the predefined cut defines a first edge and a second edge adjacent the first edge. An integrated pull strip may be defined in the second layer by forming a line of weakness in the second layer, where the pull strip overlies the predefined cut and is configured to be separated from a remainder of the second layer by a user. In this way, separation of the pull strip from the remainder of the second layer serves to expose the predefined cut and allows the first and second edges to be moved apart to provide access to the compartment and the contents stored therein via the predefined cut.

In some cases, defining the integrated pull strip in the second layer by forming a line of weakness may comprise defining a continuous cut line through a portion of a thickness of the second layer. In other cases, defining the integrated pull strip in the second layer by forming a line of weakness may comprise defining a series of perforations through a portion of a thickness of the second layer. Moreover, laminating the first layer to the second layer may comprise pattern-applying an adhesive to one of the first or second layers, and the method may further comprise defining the pull strip in an adhesive-free region of the laminate.

In some cases, defining the integrated pull strip may comprise forming a continuous cut line through the thickness of the second layer at an end of the pull strip that is configured to be gripped by the user. Furthermore, the method may comprise peripherally sealing a first panel to a second panel to define the compartment therebetween, wherein at least one of the first or second panels comprises the laminate structure.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE DRAWINGS

Figure 2:
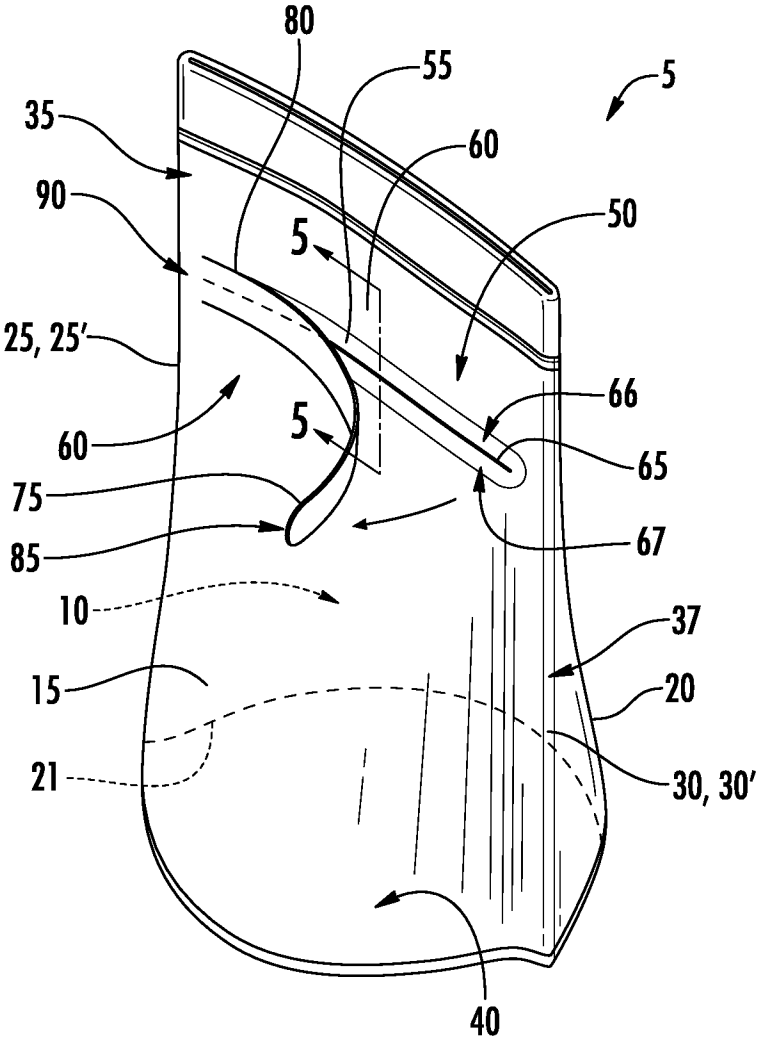
FIG. 2 is a perspective view of the package of FIG. 1, where the integrated pull strip has been partially separated from the package, according to an example embodiment.

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Conventional packages made of flexible materials, such as various polymer-based materials, are often used to hold food products, such as cookies, nuts, chips, crackers, and other items. Some conventional packages provide peelable seals or tear notches that allow a user to gain access to the contents of the package. In the case of a peelable seal, for example, a user must grip both sides of the package and pull apart the seal (e.g., at the top of the package) to open the package. The material of the package may, however, make it difficult for the user to grasp the package with sufficient strength to apply the needed force to separate the sealed edges. In addition, in some cases, the seal strength that must be overcome to open the package may be so high that the user is either unable to open the package in the intended manner, or the abrupt opening of the package once the user has applied enough force may cause the contents of the package to shift suddenly as the package is opened, possibly spilling some of the contents.

In the case of a tear notch, the user must apply a separation force in the vicinity of the notch to initiate a tear in the package that is meant to be propagated along a certain distance to create an opening. The tear is generally created through the entire structure, often in a heat seal area. The user is often required to start tearing precisely at the location of the tear notch, and often the necessary tear propagation force may be increased due to a stringy or stretchy sealant or due to material delamination. As a result, the user may again not be able to provide sufficient force to initiate the tear in some cases, and in other cases the tear that is initiated may not be propagated in a controlled manner by the user's continued application of force, which may produce an uneven or misaligned opening (e.g., propagating the tear downward rather than across the package) and can result in loss of product.

The shortcomings of such conventional opening features may often result in the user attempting to open the package using a sharp object, such as scissors or a knife, which can be dangerous and requires the user to have access to these additional opening tools.

Accordingly, embodiments of the present invention provide an integrated pull strip in an outer layer of a laminate that overlies a predefined cut formed in an inner layer of the laminate, such that a user can at least partially separate the pull strip from the rest of the package to reveal the underlying predefined cut. Once exposed, the predefined cut provides an opening for the user to gain access to the contents of the package, such as by pushing his or her fingers or hand through the predefined cut and withdrawing a desired amount of product. Because the cut in the inner layer of the laminate is predefined, the user is not required to exert an undue amount of force to try and overcome a seal strength of the package or cut through the package laminate.

Figure 1:
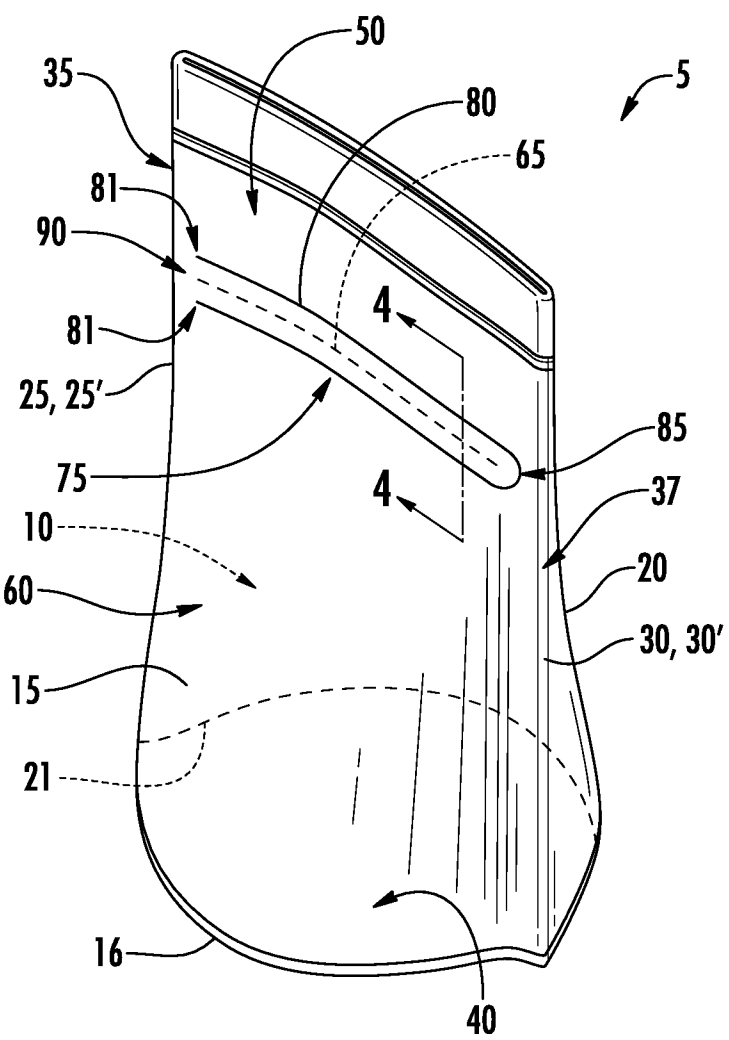
FIG. 1 is a perspective view of a package with an integrated pull strip, where the integrated pull strip has not been separated from the package, according to an example embodiment.
Figure 3:
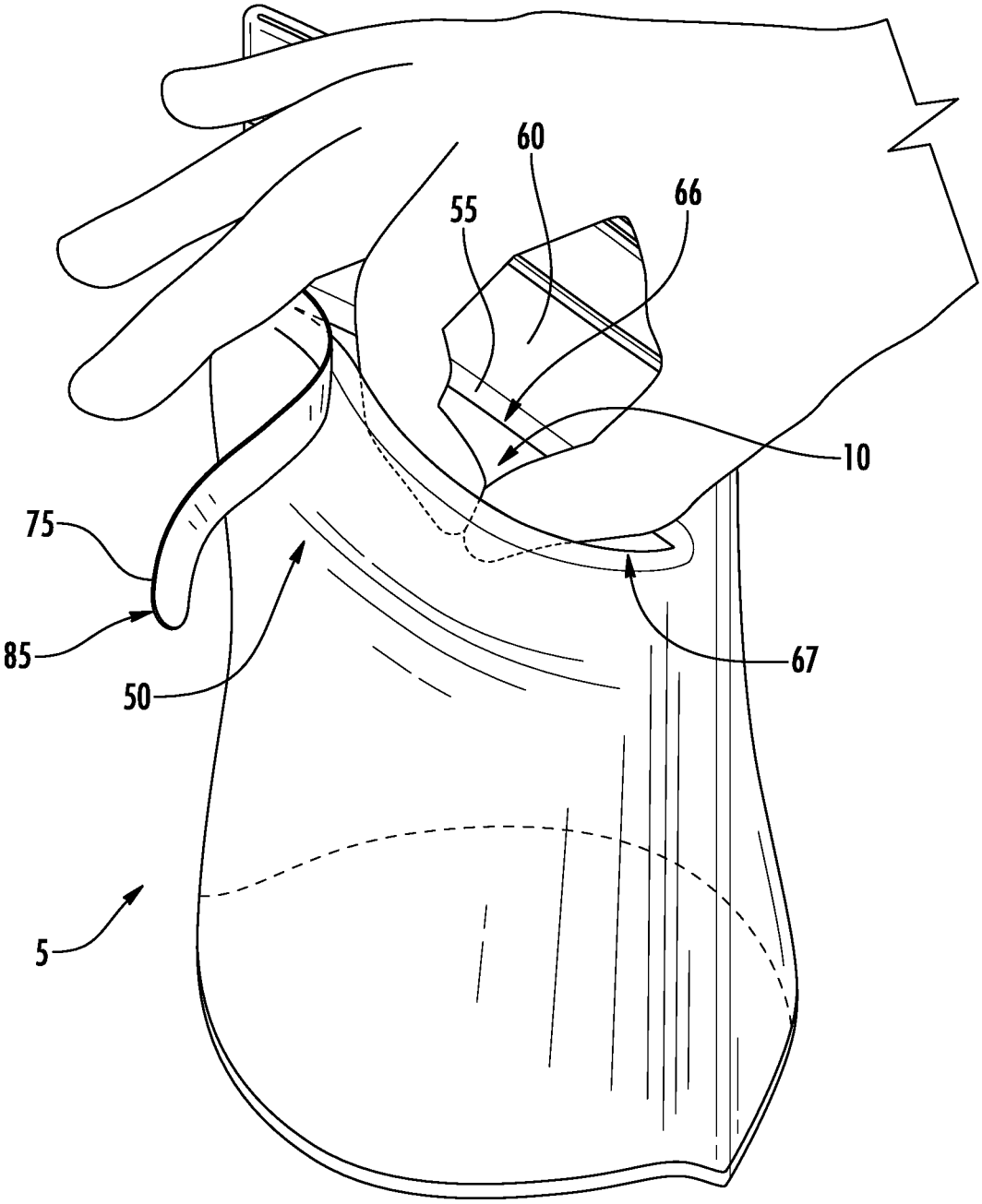
FIG. 3 is a perspective view of the package of FIG. 2 showing a user retrieving contents of the package via an opening created by a predefined cut line underlying the pull strip according to an example embodiment.

Embodiments of the invention described herein are applicable in, and may be embodied by, various kinds of packages including stand-up pouches, bags, sealed trays, or any other package that includes a flexible laminate. Thus, although the examples depicted in FIGS. 1-3 are of a stand-up pouch, it is understood that various types of other packaging structures that include a flexible packaging component may include the integrated pull strip features described herein. In addition, it is noted that although the terms "upper," "lower," "left," "right," "front," "rear," "top," and "bottom" may be used in the description herein to refer to certain parts of the depicted package, such terms are used for ease of explanation only and are not absolute. Thus, it is recognized that the depicted package, for example, may be flipped over, turned around, etc., and as a result the "bottom side" may be at the top of the package and the "top side" may be at the bottom of the package, etc.

With reference now to FIGS. 1-3, a package 5 is shown that defines a compartment 10 for storing contents. In the depicted example, the package includes a first panel 15 and a second panel 20. The first panel 15 may be peripherally sealed to the second panel 20 to define the compartment 10 therebetween, and at least one of the first or second panels may comprise the laminate structure described in greater detail below. In some cases, each of the first and second panels 15, 20 may define first and second side edges 25, 25', 30 30', and the first panel 15 may be peripherally sealed to the second panel 20 via first and second longitudinal seals 35, 37 formed along adjoining first and second side edges 25, 25' and 30, 30' (e.g., via heat sealing).

In some cases, the package may be gusseted, as shown in FIGS. 1-3, to form a stand-up pouch. Thus, a base panel 40 may be connected to base ends 16, 21 of the respective first and second panels 15, 20 to form the base of the stand-up pouch. In other cases, the base ends 16, 21 may be joined to each other without the use of an additional base panel, such as to form a bag.

Figure 4:
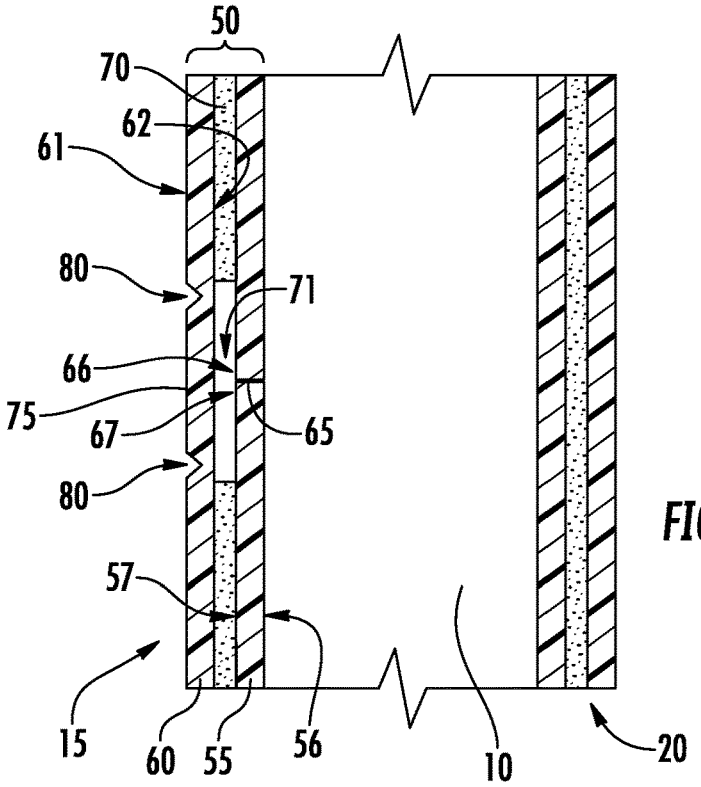
FIG. 4 shows a cross-sectional view of the of the pull strip of FIG. 1 taken away from the grippable end of the pull strip according to an example embodiment.
Figure 5:
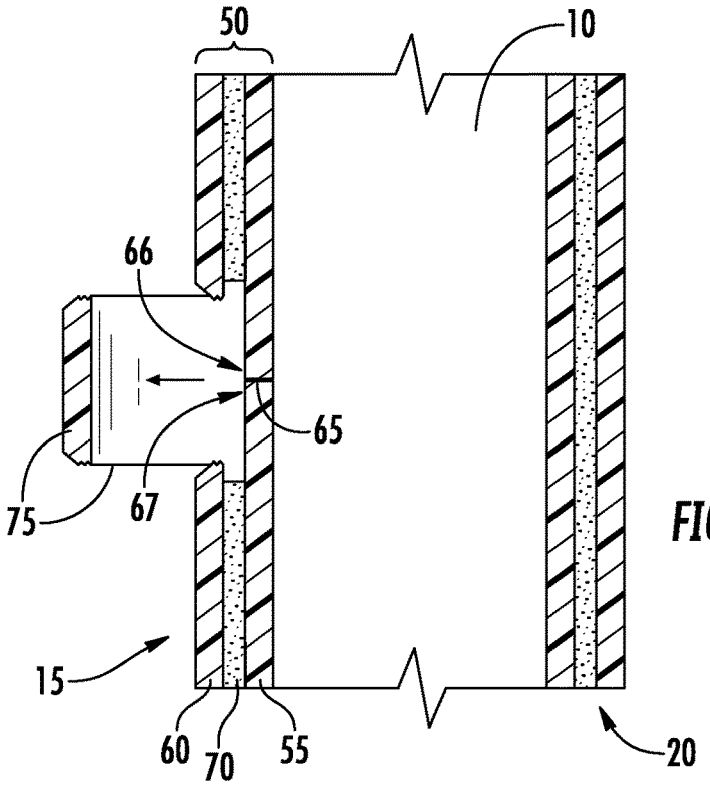
FIG. 5 shows a cross-sectional view of the pull strip of FIG. 2 taken away from the grippable end of the pull strip according to an example embodiment.

Regardless of the particular configuration of the package 5, the package may include a laminate structure 50 that includes a first layer 55 and a second layer 60 that are laminated to each other. The first layer 55 may define a first surface 56 that is adjacent the compartment 10, as well as a second surface 57 opposite the first surface, as shown in FIGS. 4 and 5. The first layer 55 may include a predefined cut 65 through the first and second surfaces 56, 57.

The second layer 60 may be laminated to the second surface 57 of the first layer 55, such as by a permanent adhesive 70. The second layer 60 may include an integrated pull strip 75 that is at least partially defined by a line of weakness 80 formed in the second layer. As best shown in FIGS. 1, 2, 4, and 5, the pull strip 75 may overlie the predefined cut 65 in the first layer 55 and may be configured to be separated from a remainder of the second layer 60 by a user. Thus, in FIG. 1, the package 5 is shown with the pull strip 75 intact, prior to the pull strip 75 being separated from the package. In FIG. 2, the pull strip 75 is shown partially separated from the second layer 60 and pulled away from the first layer 55 of the package, thereby revealing the underlying predefined cut 65.

With reference to FIGS. 2 and 5, the predefined cut 65 may define a first edge 66 and a second edge 67 that is adjacent to the first edge. For example, in some embodiments, the predefined cut 65 may comprise a slit (e.g., a single, linear cut line). In other embodiments, however, the predefined cut 65 may have a curvature or other, non-linear shape. Regardless of the shape, when the pull strip 75 is separated from the package 5 and the predefined cut 65 is exposed, the first and second edges 66, 67 are allowed to be moved apart to provide access to the compartment 10 and the contents stored therein via the predefined cut 65. In this regard, FIG. 3 shows how a user may urge the first and second edges 66, 67 of the predefined cut 65 apart to gain entry into the compartment 10. Furthermore, in some embodiments, the predefined cut may be configured such that once the user removes his or her hand from the opening formed between the first and second edges 66, 67, the edges return to their relaxed state, such that they are once again adjacent each other and service to shield the compartment and its contents from the environment to some degree.

As illustrated in FIGS. 1 and 2, in some cases the predefined cut 65 may extend at least a portion of a width of the package 5. For example, the predefined cut 65 may extend between opposite longitudinal seals 35, 37, generally parallel with a top edge of the package 5 as shown. A length of the predefined cut 65 may be determined based on the size of the package 5, the size or quantity of the items to be stored in and withdrawn from the compartment 10 of the package, the size of a typical user's hand, and/or other considerations. For example, to provide a larger opening once the pull strip 75 is separated, the predefined cut 65 may be configured to extend a longer distance between the longitudinal seals 35, 37, such as shown in the figures. In other cases, such as for other configurations of packages, the predefined cut 65 may have a different orientation than that shown (e.g., vertically, diagonally, etc.), may be in a different location (e.g., bottom of the package, side of the package, etc.), or may have a different length (e.g., shorter to provide a smaller opening).

In some embodiments, the predefined cut 65 may be defined via laser scoring or die cutting through the first layer, from the first surface 56 to the second surface 57, such that the cut goes through both surfaces. In the depicted embodiment, the predefined cut 65 is a continuous cut line; however, in other embodiments, the predefined cut 65 may be discontinuous (e.g., a series of perforations that the user can push through after peeling the pull strip 75 off).

The line of weakness 80 defined in the second layer 60 may define a shape of the pull strip 75, as shown in FIGS. 4 and 5. In some cases, the line of weakness 80 may comprise a continuous cut line that is defined through a portion of a thickness of the second layer 55. For example, the line of weakness 80 may be cut through a first surface 61 of the second layer 55, but may not extend to a second surface 62 of the second layer that is opposite the first surface. In other cases, the line of weakness 80 may comprise a series of perforations, and the perforations may extend from the first surface 61 of the second layer through to the second surface 62 of the second layer. As noted above with respect to the predefined cut 65, the line of weakness 80 may be defined via laser scoring or die cutting through a portion of the thickness of the second layer 60.

In some embodiments, the second layer 60 (e.g., the second surface 62 of the second layer 60) may be laminated to the second surface 57 of the first layer via an adhesive 70, such as a permanent adhesive. The adhesive 70 may be pattern applied, and the pull strip 75 may be defined in an adhesive-free region 71 of the laminate. In this way, when a user pulls on the pull strip 75, there is no adhesive holding the pull strip to the underlying portion of the first layer 55, and the pull strip can be separated upon tearing through the lines of weakness 80.

In this regard, the pull strip 75 may comprise an end 85 configured to be gripped by the user to initiate the separation of the pull strip from the package. The end 85 may be defined by the path of the line of weakness 80. For example, as best illustrated in FIG. 1, the line of weakness 80 may have two free ends 81 disposed at an anchor end 90 of the pull strip 75, such that the pull strip remains attached to the package 5 after the predefined cut 65 has been exposed. The line of weakness 80 may extend from one of the free ends 81 at the anchor end 90 to the end 85 configured to be gripped by the user, then back to the other free end 81 at the anchor end 90, such that the path of the line of weakness is an elongated "U" shape. In other cases, however, the line of weakness 80 may define a closed shape, and separation of the pull strip 75 from the package may result in the pull strip being removed from the package all together (e.g., no anchor end 90).

Figure 6:
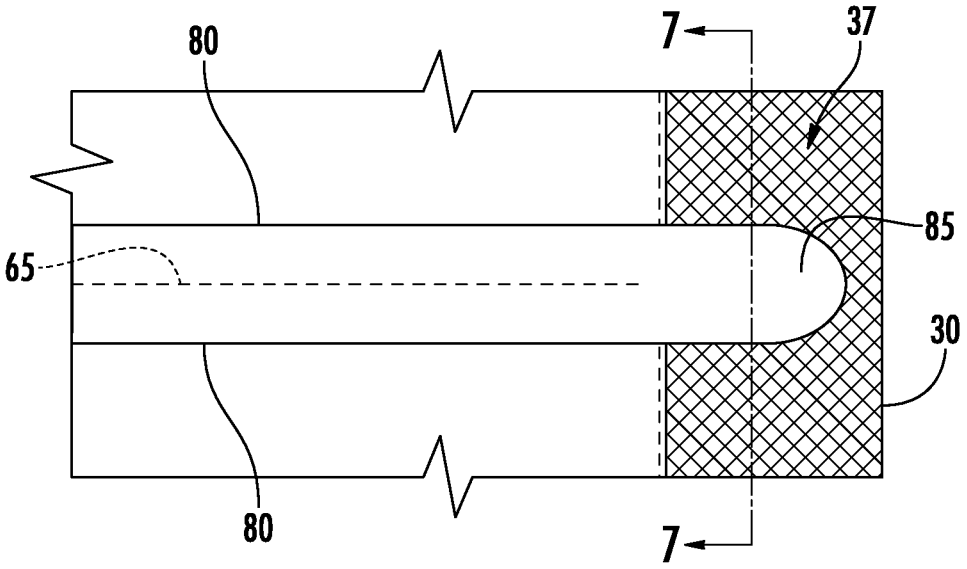
FIG. 6 is a close-up view of the end of the pull strip showing the grippable end of the pull strip and a corresponding portion of the longitudinal seal line according to an example embodiment.
Figure 7:
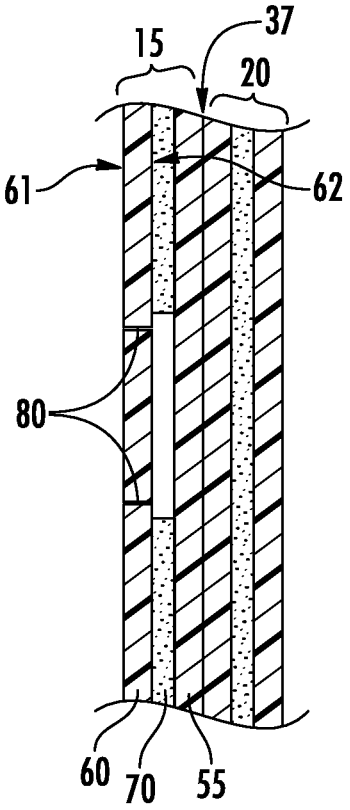
FIG. 7 is a cross-sectional view of the integrated pull strip at the grippable end showing a heat seal between the first and second panels according to an example embodiment.

With reference to FIGS. 6 and 7, to allow a user to grip the end 85 and begin separating the pull strip 75 from the package, the end 85 may be defined via a continuous cut line formed through the thickness of the second layer 60. The cut of the line of weakness 80 may thus, in the area of the grippable end 85, extend all the way through the second layer 60, as shown in FIG. 7.

In some embodiments, the pull strip 75 comprises an end 85 defined in one of the first or second longitudinal seals 35, 37. In the depicted embodiment, for example, the grippable end 85 is defined in the second longitudinal seal 37. A close-up view of the end 85 is shown in FIG. 6. As noted above, the end 85 may be configured to be gripped by the user and may be defined via a continuous cut line 80 formed through the thickness of the second layer 60. Thus, as shown in FIG. 7, in the area of the longitudinal seal 37, the first surface 56 of the first layer 55 of the first panel 15 (e.g., shown in FIG. 4) proximate its second side edge 30 is sealed to a corresponding surface of second panel 20 proximate its second side edge 30, such as via a heat sealing, as described above. Accordingly, the first layer 55 and the corresponding material of the second panel 20 to which the first layer 55 of the first panel 15 is heat sealed may comprise a heat sealable materials such as polyethylene-based films (e.g., low density polyethylene (LDPE), linear low density polyethylene (LLDPE), Surlyn® resin, metallocene, etc.), polypropylene, and/or heat-sealable polyester films and/or may comprise heat sealable coatings such as polyolefin or vinyl acrylic-based heat seal coatings or dispersions.

The presence of the continuous cut line 80 going all the way through the second layer 60 of the first panel 15 to form the grippable end 85 and the lack of adhesive 70 in the area of the pull strip 75, including at the end 85, thus allow a user to separate the end from the package (e.g., using a fingertip), grip the end 85, and pull the pull strip 75 off the package to gain access to the predefined cut 65 and the contents held inside the package.

By providing a pull strip 75 overlying a predefined cut 65 according to embodiments of the invention as described above, the user is able to open the package more easily by applying a consistent and not unduly burdensome force to separate the pull strip from the package. Moreover, because the underlying cut 65 is predefined, no additional force or action is needed by the user to gain access to the package contents, and the user need only insert his or her hand between the edges 66, 67 of the predefined cut.

Embodiments of a method of manufacturing a package including an integrated pull strip with underlying predefined cut for providing access to contents stored within a compartment of the package as described above are also provided herein. The method may, for example, comprise laminating a first layer to a second layer to form a laminate structure, where the first layer defines a first surface, adjacent a compartment of the package, and a second surface opposite the first surface. A predefined cut may be formed in the first layer through the first and second surface, as described above, where the predefined cut defines a first edge and a second edge adjacent the first edge. An integrated pull strip may be defined in the second layer by forming a line of weakness in the second layer.

As described above with respect to the figures, the pull strip may overlie the predefined cut and may be configured to be separated from a remainder of the second layer by a user. Accordingly, separation of the pull strip from the remainder of the second layer may serve to expose the predefined cut and allow the first and second edges to be moved apart to provide access to the compartment and the contents stored therein via the predefined cut.

In some embodiments, defining the integrated pull strip in the second layer by forming a line of weakness may comprise defining a continuous cut line through a portion of a thickness of the second layer. In other embodiments, defining the integrated pull strip in the second layer by forming a line of weakness may comprise defining a series of perforations through a portion of a thickness of the second layer. Moreover, laminating the first layer to the second layer may comprise pattern-applying an adhesive to one of the first or second layers, and the pull strip may thus be defined in an adhesive-free region of the laminate.

In some cases, defining the integrated pull strip may comprise forming a continuous cut line through the thickness of the second layer at an end of the pull strip that is configured to be gripped by the user, as described above. Furthermore, a first panel and a second panel of material, at least one of which comprises the laminate structure, may be peripherally sealed to each other to form the package and define the compartment therebetween. In some embodiments, for example, the first and second layers may first be laminated together via permanent adhesive, then the cuts in the two layers may be defined (e.g., via precision cutting) to form the pull strip and the underlying predefined cut. The laminate can then be used to form a pouch or other package, such as by heat sealing one or more ends of the package, filling the package with contents, then sealing the remaining sides of the package to form a compartment filled with the consumer item, as described above.

Although the steps in the method of manufacturing the package described above are described in a certain order, it is understood that in some cases the order of the steps may be changed. Moreover, additional steps, such as, for example, printing indicia on the laminate structure, may also be included in some cases. For example, in some embodiments, the end 85 (e.g., shown in FIG. 6) may include printed indicia indicating that the user is to grip the pull strip 75 at the end 85 for opening the package, thereby making the location and function of the pull strip easily identifiable.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A package defining a compartment for storing contents, the package comprising:

a first panel and a second panel defining first and second side edges, wherein the first panel comprises a laminate structure including:

a first film layer defining:

a first surface, adjacent the compartment, and a second surface opposite the first surface, wherein the first film layer includes a predefined cut through the first and second surfaces; and a second film layer laminated to the second surface of the first film layer via a pattern-applied adhesive, and comprising, in an adhesive-free region of the laminate:

an integrated pull strip that is defined on at least two sides by a continuous line of weakness formed through a portion, but not through the entire thickness, of the second film layer and generally comprises an elongated shape, wherein at least the portion of the second film layer which comprises the pull strip is not heat-sealed to the first film layer, wherein the second panel includes at least:

a second panel film layer, adjacent the compartment, and configured to be heat-sealable with the first film layer of the first panel, wherein the first panel is peripherally sealed to the second panel via first and second longitudinal seals formed by heat sealing the first film layer of the first panel to the second panel film layer along the adjoining first and second side edges to define the compartment therebetween, wherein the pull strip of the second film layer comprises:
an end defined via a continuous cut line formed through the entire thickness of the second film layer, wherein the end is disposed within the heat-sealed second longitudinal seal,
wherein the pull strip overlies the predefined cut and is configured to be separated from a remainder of the second film layer by a user,
wherein the predefined cut defines a first edge and a second edge adjacent the first edge, and
wherein separation of the pull strip from the package serves to expose the predefined cut and allows the first and second edges to be moved apart to provide access to the compartment and the contents stored therein via the predefined cut.

2. The package of claim 1, wherein the predefined cut extends at least a portion of a width of the package.

3. The package of claim 1, wherein the end is configured to be gripped by the user.

4. The package of claim 1, wherein the pull strip comprises an elongated "U" shape.

5. The package of claim 1, wherein the pull strip comprises a closed shape.

6. The package of claim 1, wherein the pull strip comprises a single pull strip.

7. The package of claim 1, wherein the package comprises a base panel connected to base ends of the first and second panels, forming a gusseted stand-up pouch.

8. The package of claim 1, wherein the predefined cut begins adjacent the first longitudinal seal and extends across a width of the package to a point which is adjacent the second longitudinal seal.

9. The package of claim 1, wherein the predefined cut is generally parallel with a top edge of the package.

10. A package comprising:
a first panel and a second panel defining first and second side edges,
wherein the first panel comprises a laminate structure comprising:
a first film layer defining:
a first surface, and
a second surface opposite the first surface,
wherein the first film layer includes a predefined cut through the first and second surfaces; and
a second film layer laminated to the second surface of the first film layer via a pattern-applied adhesive, and comprising in an adhesive-free region of the laminate:
a single integrated pull strip that is defined on at least two sides by a series of perforations formed through the second film layer and generally comprises an elongated shape, wherein at least the portion of the second film layer which comprises the pull strip is not heat-sealed to the first film layer,
wherein the second panel includes at least:
a second panel film layer, adjacent the first surface of the first panel, and configured to be heat-sealable with the first film layer of the first panel,
wherein the first panel is peripherally sealed to the second panel via first and second longitudinal seals formed by heat sealing the first film layer of the first panel to the second panel film layer along the adjoining first and second side edges to define the compartment therebetween,
wherein the pull strip of the second film layer comprises:
an end defined via a continuous cut line formed through the entire thickness of the second film layer, within the heat-sealed second longitudinal seal,
wherein the pull strip overlies the predefined cut and is configured to be separated from a remainder of the second film layer by a user,
wherein the predefined cut defines a first edge and a second edge adjacent the first edge, and
wherein separation of the pull strip from the remainder of the second film layer serves to expose the predefined cut of the first film layer and allows the first and second edges to be moved apart.

11. The laminate structure of claim 10, wherein the end of the pull strip is configured to be gripped by the user.

12. The laminate structure of claim 10, wherein the predefined cut line comprises a slit.

13. A method of manufacturing a package including an integrated pull strip for providing access to contents stored within a compartment of the package, the method comprising:
providing a first panel and a second panel defining first and second side edges,
wherein the first panel comprises a laminate structure formed by:
laminating a first film layer to a second film layer by pattern-applying an adhesive between the first and second film layers, wherein the first film layer defines:
a first surface, adjacent the compartment of the package, and
a second surface opposite the first surface;
forming a predefined cut in the first film layer through the first and second surfaces, wherein the predefined cut defines:
a first edge, and
a second edge adjacent the first edge; and
defining an integrated pull strip in the second film layer by forming a line of weakness about at least two sides of an elongated pull strip shape in the second film layer,
wherein the second panel includes at least:
a second panel film layer, adjacent the compartment, and configured to be heat-sealable with the first film layer of the first panel,
peripherally sealing the first panel to the second panel to form first and second longitudinal seals by heat sealing the first film layer of the first panel to the second panel film layer along the adjoining first and second side edges to define the compartment therebetween,
wherein the pull strip of the second film layer comprises an end formed in an adhesive-free region of the laminate by:
defining a continuous cut line through the entire thickness of the second film layer, within the heat-sealed second longitudinal seal,
wherein the pull strip overlies the predefined cut and is configured to be separated from a remainder of the second film layer by a user, and
wherein separation of the pull strip from the remainder of the second film layer serves to expose the predefined cut and allows the first and second edges to be moved apart to provide access to the compartment and the contents stored therein via the predefined cut.

14. The method of claim 13, wherein defining the integrated pull strip in the second film layer the forming the line of weakness comprises defining a continuous cut line through a portion of a thickness of the second film layer.

15. The method of claim 13, wherein defining the integrated pull strip in the second film layer by forming the line of weakness comprises defining a series of perforations through a portion of a thickness of the second film layer.

* * * * *